US005607243A

United States Patent [19]

Szarka

[11] Patent Number: 5,607,243

[45] Date of Patent: Mar. 4, 1997

[54] REAR SECTION LOCATED AND STABILIZED PALLET SUPPORT PLATE AND METHOD FOR ACCURATE POSITIONING OF SAID PLATE

[75] Inventor: Sandor Szarka, Franklin Lakes, N.J.

[73] Assignee: Svecia USA, Inc., Oakland, N.J.

[21] Appl. No.: 611,620

[22] Filed: Mar. 6, 1996

[51] Int. Cl.[6] ..... B41F 15/10

[52] U.S. Cl. ..... 101/126; 101/129

[58] Field of Search ..... 101/114, 115, 101/126, 129

[56] References Cited

U.S. PATENT DOCUMENTS

| | | | |
|---|---|---|---|
| 4,031,825 | 6/1977 | Jaffa | 101/126 |
| 4,407,195 | 10/1983 | Jaffa | 101/126 |
| 4,735,139 | 4/1988 | Szarka | 101/126 |
| 4,909,146 | 3/1990 | Szarka | 101/126 |
| 5,456,172 | 10/1995 | Herrmann | 101/129 |

*Primary Examiner*—Ren Yan

*Attorney, Agent, or Firm*—W. Patrick Quast, Esq.

[57] ABSTRACT

A rear section pallet support plate locator and stabilizer is described for use in a screen printing machine. In place of traditional front plate locators or dual front and rear plate locators, a unique two tiered construction of the support plate provides for both front to back and side to side precise positioning and stabilizing of the entire support plate. A locator roller contacts a "V" shaped notch in a stepped lower rear section of the support plate, biasing stabilizer bars on the rear edge of the rear section against pre-positioned cam followers. Precisely positioning and stabilizing the rear section also positions and stabilizes the entire pallet support plate. The front section of the pallet support plate is now completely free of obstruction, permitting processing of closed end bags, long garments, and other objects that could not be processed with screen printing machines having front locator devices.

13 Claims, 6 Drawing Sheets

REAR SECTION LOCATED AND STABILIZED PALLET SUPPORT PLATE AND METHOD FOR ACCURATE POSITIONING OF SAID PLATE

BACKGROUND OF THE INVENTION

This invention relates to the screen printing process, and more specifically to multicolor screen printing procedures involving accurately registering in series more than one color on an object supported on a pallet connected to a movable pallet support plate.

Screen printing is a process widely used today for a wide variety of products including art work, electronic circuits, instrument panels, and articles of clothing. For example, today's popular T shirts are often mass produced on screen printing machines capable of printing several thousand of such multicolored objects per hour. The basic process involves flooding a screen with ink, and then utilizing a squeegee to force the ink through previously prepared openings in the screen, the screen being in contact with the object to be printed upon during the print cycle of the machine.

In current screen printing machines objects, such as T shirts, are often affixed to movable pallets connected to pallet support plates. These plates are caused to be moved from one print head to another so as to sequentially impress the object to be printed upon with a different ink color. Obviously the aesthetic quality of the finished multicolored product will be greatly affected according to the accuracy with which each pallet is positioned in relationship to each of the print heads delivering a different color. And, of course, this pallet positioning accuracy must be accomplished in a ruggedly reliable and economical manner in order to produce a competitive product in quantity.

The problem of accurately positioning pallet support plates has been addressed in the past, as is evident from U.S. Pat. No. 3,795,189, issued Mar. 5, 1974. This patent teaches utilizing an oval rail for indexing a number of pallet support plates for registration with a number of printing heads located about the oval rail. Once a timed sequence places a plate beneath an appropriate printing head a pneumatically driven device then causes a locating bar 35 (FIG. 1) to meet and press against a notch 34 (FIG. 1) at the outside edge of the pallet support plate, thereby securing that plate under the print head immediately prior to the print cycle. Once the print cycle is complete, the locating bar is caused to be moved away from the notch in the plate, freeing the plate to be moved to the next color print head station.

Again, in U.S. Pat. No. 4,735,139 a screen printing machine similar to the one described above addresses the problem of positioning a pallet support plate 10 (FIG. 1) by utilizing a dual locator means. In this case the print head frame 18 (FIG. 1) itself locates the rear section of the plate 10 by means of a slot 22 on the edge of the print head frame which engages a cam follower 16 (FIG. 2) rotatably attached to the rear section of the plate 10. Simultaneously, a "V" shaped slot 23 (FIG. 1) on the outer edge of the plate is located and pressed by locator-roller 24 (FIG. 1) on outer locator assembly 25 (FIG. 1). Provisions are described for the release of both inner and outer edges of the plate at the conclusion of a print cycle in order to free the plate for movement to the next color print station.

An additional disclosure is added to U.S. Pat. No. 4,735,139 in U.S. Pat. No. 4,909,146, issued Mar. 20, 1990. This patent teaches an additional dual patent support plate locator system which is not attached to the print head itself. In this case two pneumatically operated roller support arms 60, 64 (FIG. 7) insert rollers 60A and 64A into locator notches 82, 83 (FIG. 7) at opposite ends of the pallet support plate 61 immediately prior to the print cycle, and a timed sequence then causes the rollers to release from the locator notches at the conclusion of the print cycle.

While the above referenced inventions provide useful devices and methods for positioning pallet support plates during screen printing cycles, they do not fully address the concerns of the instant invention. In all of the above disclosures means are required for locating and connecting with, at a minimum, the front end of the pallet support plate. In the instant invention the front section pallet support plate locator is completely eliminated, thereby significantly adding to the versatility of the over all printing machine, and to important simplifications in apparatus construction and maintenance.

Therefore a primary object of the invention is to accurately locate and stabilize a pallet support plate beneath a print head and the print head's associated screen during the print cycle of a screen printing machine.

An additional object of the invention is to accurately locate and stabilize a pallet support plate both front to back and laterally in the plate's spacial relation to a print head and the print head's associated screen during the print cycle of a screen printing machine.

A further object of the invention is to provide accurate location and stabilization of a pallet support plate during screen printing at each printing station, while at the same time maintaining full access to the front of the plate for loading and unloading procedures.

Another object of the invention is to provide for an economical manner for locating and stabilizing a pallet support plate during screen printing.

Still another object of the invention is to provide for reduced maintenance associated with locating and stabilizing pallet support plates in screen printing machines.

SUMMARY

These and other objects are obtained in the instant invention of a rear section located and stabilized pallet support plate.

As has been noted above, in one type of screen printing machine objects to be screen printed as, for example, T shirts, are affixed to pallets which in turn are secured to pallet support plates. These plates are usually arranged in a horizontal plane above a generally oval shaped printing apparatus frame. Each plate is connected at its rear section to a flexible drive means as, for example, a chain drive. Usually a motor driven timed sequence is used to move the chain and hence index each plate from one printing station to another as required by the printing procedure. Each printing station has a print head and associated print screen which can be lowered into print position and then raised during the sequential printing process. When a given pallet support plate with its attached pallet and T shirt to be imprinted is indexed to a particular printing station it is essential that the plate be further located and stabilized immediately prior to the print cycle of the printing station. The pallet support plate must be free to travel smoothly and easily from one printing station to another. This necessitates a certain amount of "give" in each plate, especial regarding the chain drive connection to the plate which will be more fully explained. In the past it has been found necessary to firmly locate and "lock" the support plate in place beneath the print head, thereby eliminating any front to back or side to side deviations in the position of the plate which would later show up as out of registry color prints on the T shirt. To provide this precise alignment of the support plate it was found necessary to locate and bias together both the front section and the rear section of the pallet support plate. One unfortunate side effect caused by this necessary plate positioning was the fact that objects, such as bags with their closed ends, and long garments could not be loaded onto these pallets. And the dual locator system of the past necessitated a fairly complicated and costly structure to effectuate.

In the instant invention it has been found that a single pallet support plate locator cooperating with a pair of plate stabilizers provides a ruggedly reliable and economical method for accurate pallet support plate positioning during a screen printing cycle at each printing station, and does so while maintaining full access to the front section of the pallet for loading and unloading objects to be screen printed. The pallet support plate of the invention is fabricated in three confluent sections, a rear section, a front section (comprising the main portion of the plate) which secures the pallet, and an intermediate step section which connects the rear and front sections together in parallel planes but with the rear section now located a spaced distance below the front section. This rear section is substantially rectangular in shape, having a rear edge (defined as the edge that is immediately adjacent the chain drive), and a front edge (defined as the edge immediately adjacent the step section). This front edge of the rear section has a substantially "V" shaped notch cut midway along the width of this edge, the purpose of which will be more fully discussed. Two openings are provided adjacent the rear edge of the rear section for attachment of the support plate to the chain drive. A pair of steel stabilizer bars are affixed to the rear edge of the rear section, one adjacent the left hand corner of the rear section, and the second adjacent the right hand corner of the rear section. To connect the pallet support plate to the frame of the screen printing machine the upper face of the rear section of the plate is secured under a first rail of the machine frame wherein pins, connected to the chain drive (the chain drive also runs beneath this first rail), said pins being located beneath and perpendicular to the direction of travel of the chain drive, connect to the two openings in the rear section. The lower surface of the first section, which has a friction decreasing sheet of polyethylene affixed to it, now rests on a second rail of the machine frame which is positioned parallel to and above the first rail at a spaced distance from the first rail. A locator plate is connected between the first and second machine rails at each of the printing stations. A pneumatically operated locator arm and attached roller is affixed to this locator plate together with two rotatably mounted cam followers.

The pallet support plate locator stabilizer mechanism operates in the following manner. Once the support plate is connected to the chain drive and the screen printing machine is activated the support plate is automatically indexed beneath an appropriate print head and print screen assembly. A cylinder on the locator arm now is activated, causing the roller on the locator arm to be pressed into the "V" shaped notch in the middle of the front edge of the rear section of the support plate. This action in turn causes the two stabilizer bars on the rear edge of the rear section to be pressed firmly against the two cam followers rotatably connected to the same locator plate as is the locator arm and attached roller. The cam followers, roller, and rear section of the pallet support plate are now all connected together in the same plane. With the rear section of the support plate now firmly locked in place, and with the upper surface section of the rear section of the support plate secured beneath the first rail of the machine, and with the lower surface of the main section of the support plate being firmly supported by the second rail of the machine, the entire pallet support plate and its associated pallet and object to be printed upon are now precisely located and stabilized, insuring that the ensuing print cycle is accurately delivered to the print object. At the conclusion of the print cycle the locator arm and attached roller is automatically released in a timed sequence from the "V" shaped notch in the rear section, permitting the pallet support plate to be indexed on to the next printing station.

While the above rear section mechanism for locating and stabilizing a pallet support plate makes use of a rear section positioned a spaced distance below the front section by means of an intermediate step section, it would also be possible to structure the entire pallet support plate in a single plane. In this case an opening can be provided near the rear section of this support plate so that a locator roller could access this opening in the plate to effectuate the same locating and stabilizing mechanism as described above for the pallet support plate with a stepped down rear section.

DETAILED DESCRIPTION

Figure 1:
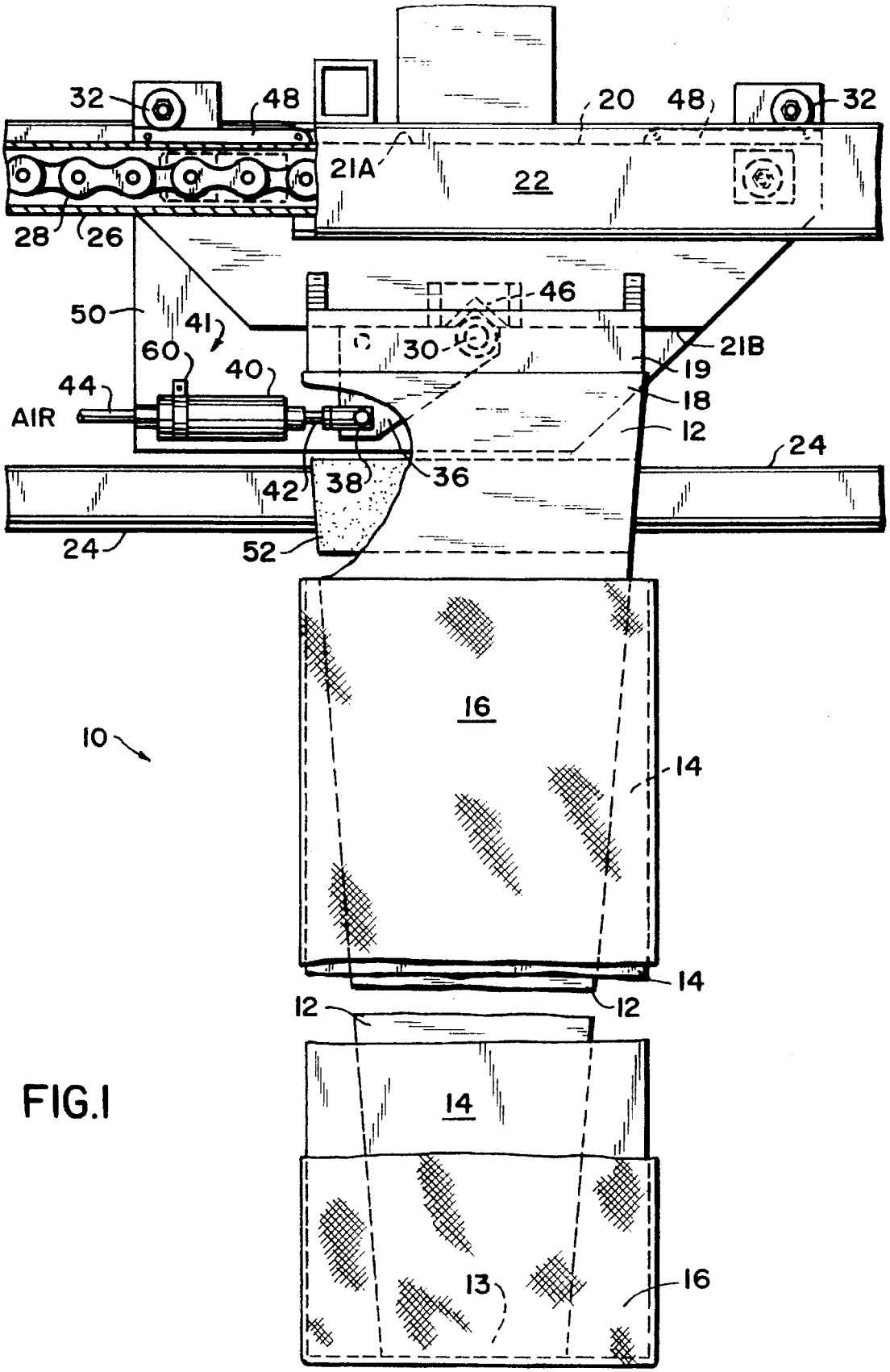
FIG. 1 is a top plan, partially fragmentary view of the rear section locator and stabilizer mechanism for one version of the Pallet Support Plate Assembly of the invention.
Figure 1A:
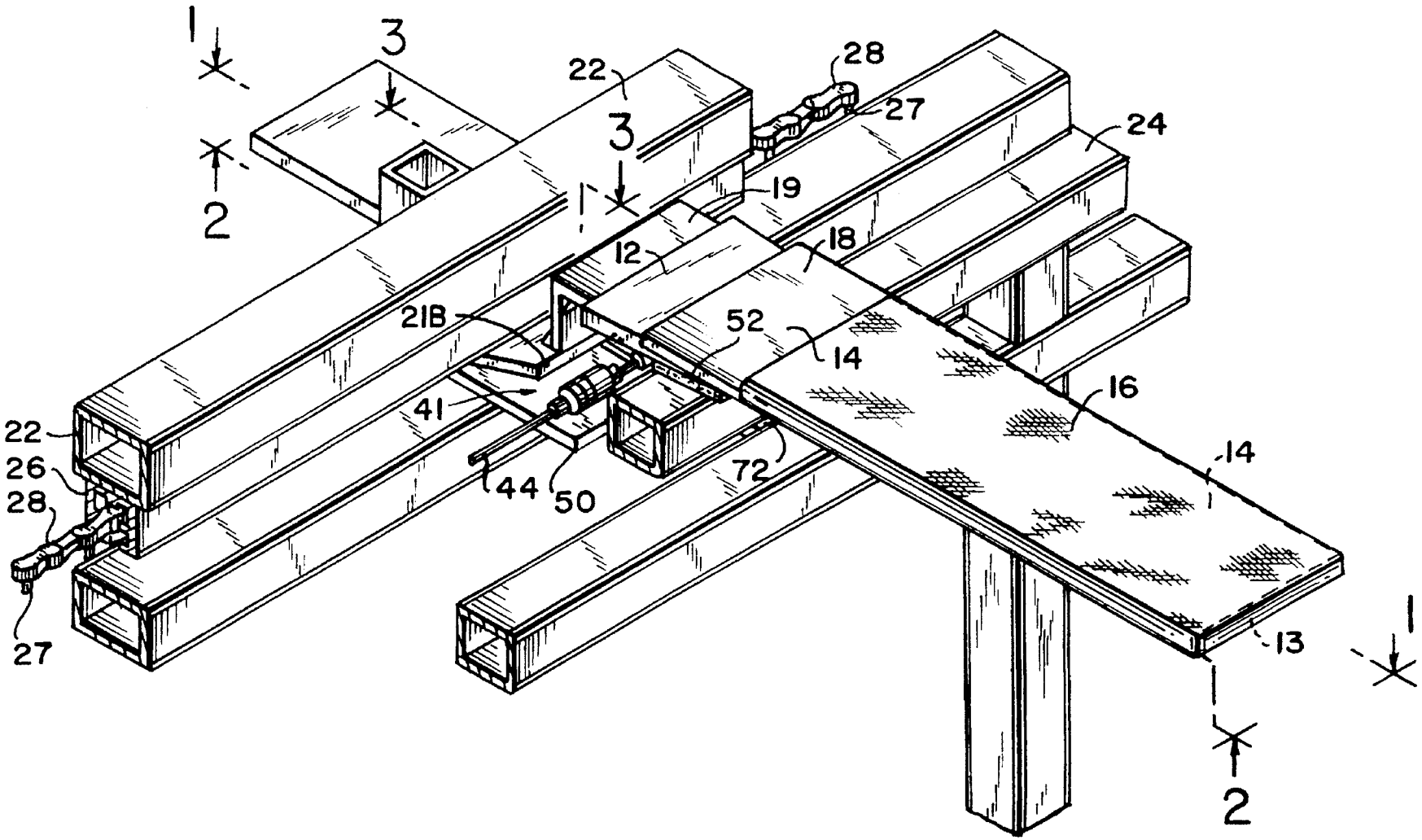
FIG. 1A is a perspective view of one version of the rear section located and stabilized pallet support plate assembly of the invention.
Figure 4:
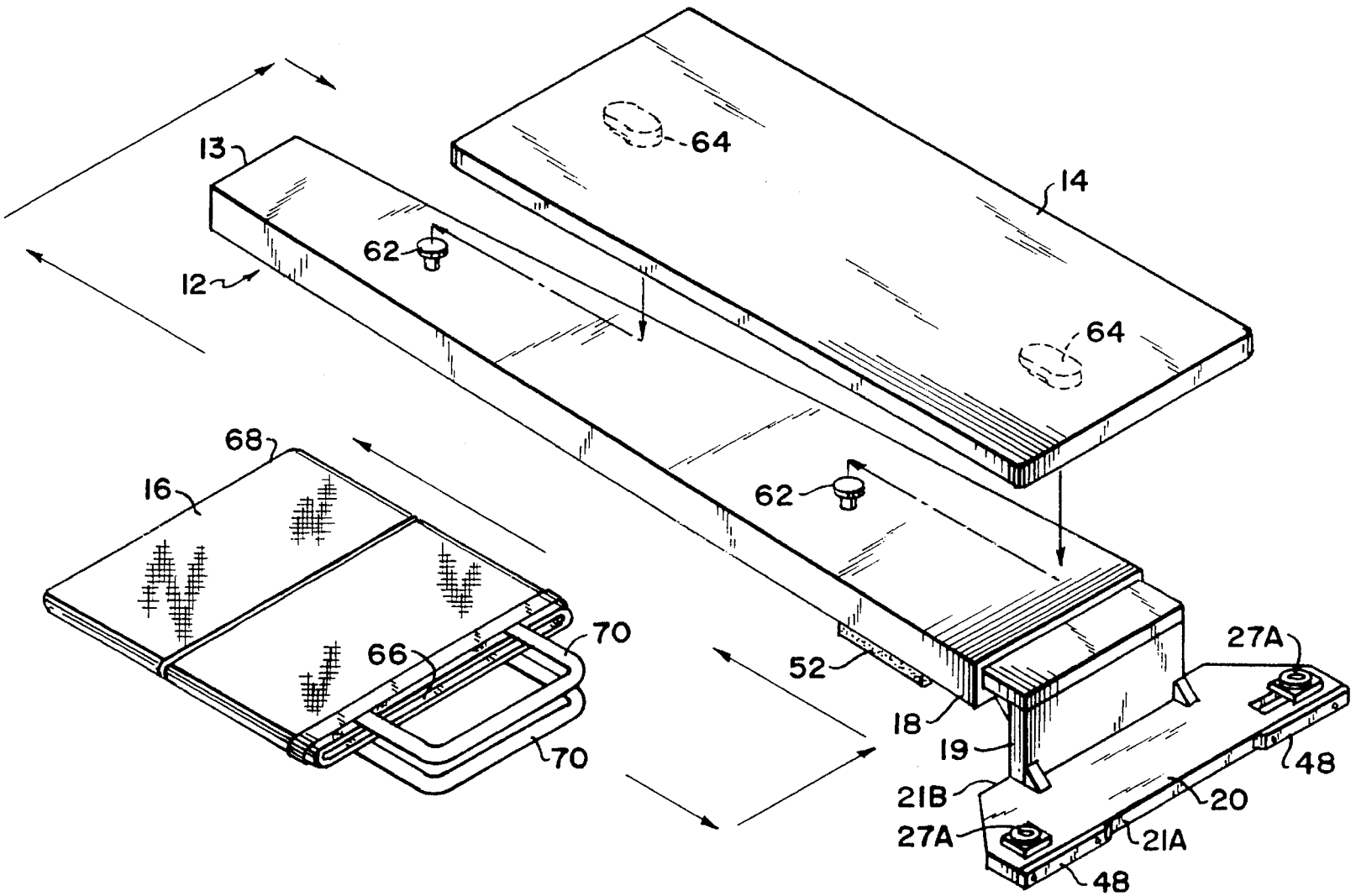
FIG. 4 illustrates an exploded view of one version of the Pallet Support Plate with attached pallet and print object.

Turning now to the drawings, in FIGS. 1 and 1A a version of the pallet support plate, pallet, print object assembly 10 of the invention is shown together with a version of the rear section locator and stabilizer mechanism. The print object in this case is a bag 16 substantially covering the front section 18 of the pallet support plate 12 shown in dotted lines. As best seen in FIG. 4 this version of the pallet support plate assembly consists of a pallet support plate 12, pallet 14, and bag 16. The pallet support plate itself consists of three sections, an elongated front section 18, a generally rectangular shaped rear section 20 (FIG. 5), and a step section 19 which connects the rear section 20 to the front section at a spaced distance below and in a parallel plane to the front section. Pallet clamps 62 on the upper surface of the support plate provide for convenient connection of a suitable pallet 14, the pallet being equipped with matching openings 64 for securing to the support plate. The pallet support plate and pallet can be fabricated out of a wide variety of rigid materials including plastics and metals, in this case aluminum being the preferred material.

Figure 5:
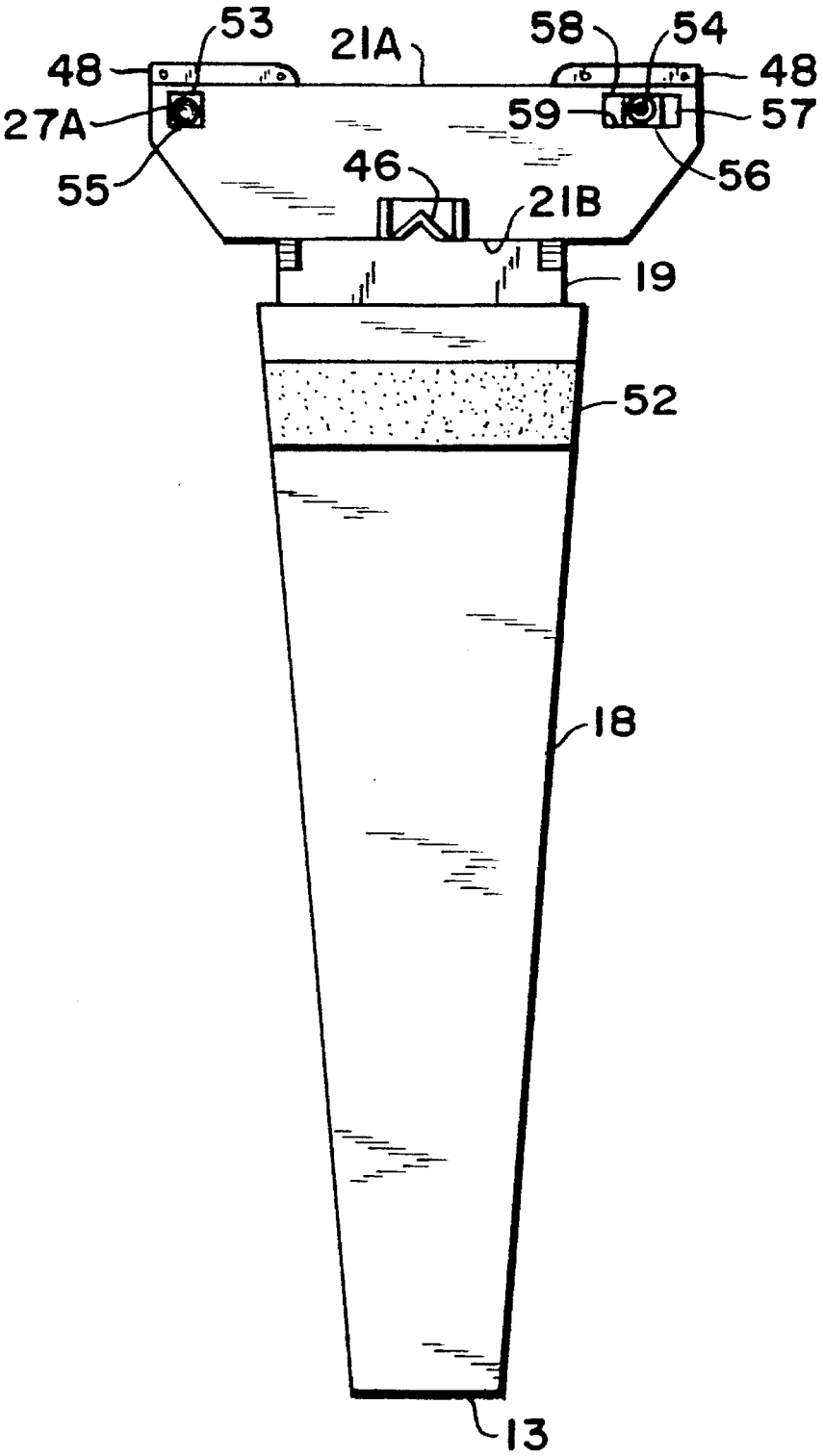
FIG. 5 is a bottom plan view of one version of the Pallet Support Plate.

As best seen in FIG. 5, the lower surface of the front section 18 of the support plate has a pad of polyethylene or other suitable low friction material affixed to that portion of the front section that is supported by the second rail 24 (FIG. 1) of the screen printing machine. The rear edge 21A of the plate's rear section has a stabilizer bar 48 affixed immediately adjacent both the left and right hand corners of the rear edge 21A. The stabilizer bars are flat faced, and rectangular is shape, preferably fabricated in steel for long term wearing characterists. A "V" shaped notch 46 is fabricated at the middle of the width of the front edge 21B. The cooperative functioning of the stabilizer bars 48 and the "V" shaped notch 46 in the rear section 20 of the plate 12 will be more fully discussed.

Two bushings (53, 54) at both corners of the rear section 20 of the support plate 12 (immediately adjacent the stabilizer bars 48) provide the means for connecting the pallet support plate 12 to the chain drive 28 mechanism of the screen printing machine. Bushing 53 contains elastomeric (as, for example, rubber) grommet 55 containing opening 27A for securing pin 27 on the chain drive 28, while bushing 54 contains elastomeric grommet 56, and similarly opening 27A for securing a chain drive pin. Grommet 56 is located in a slide block 57 affixed to slide rails 58 and 59. The purpose of this sliding grommet assembly is to permit smooth travel of the pallet support plate around the curved rails of the screen printing machine when the plate is being indexed from one printing station to another.

Figure 2:
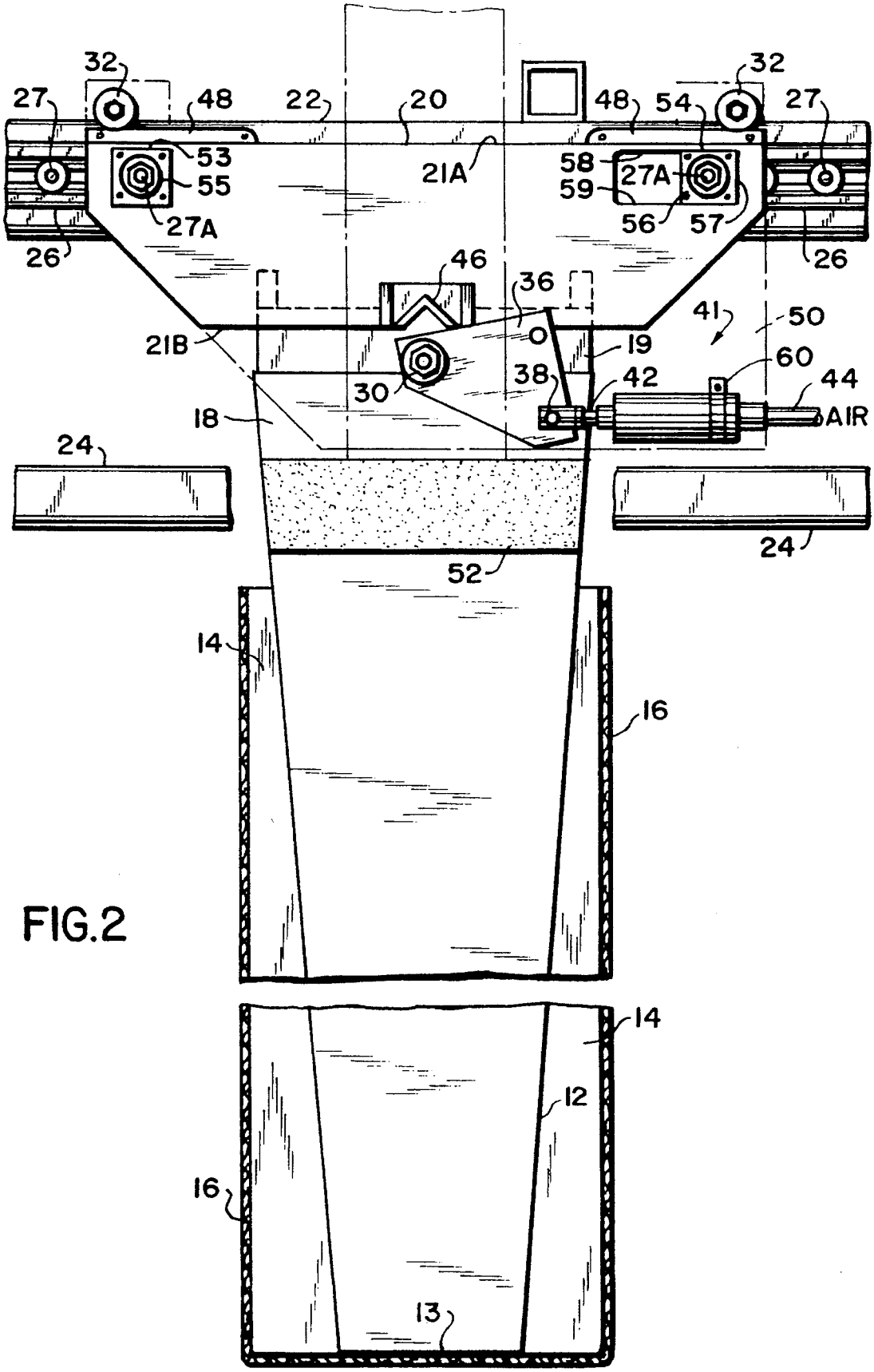
FIG. 2 is a bottom plan view of one version of the Pallet Support Plate Assembly of the invention in position for screen printing, with the locator assembly shown immediately prior to activation.
Figure 3:
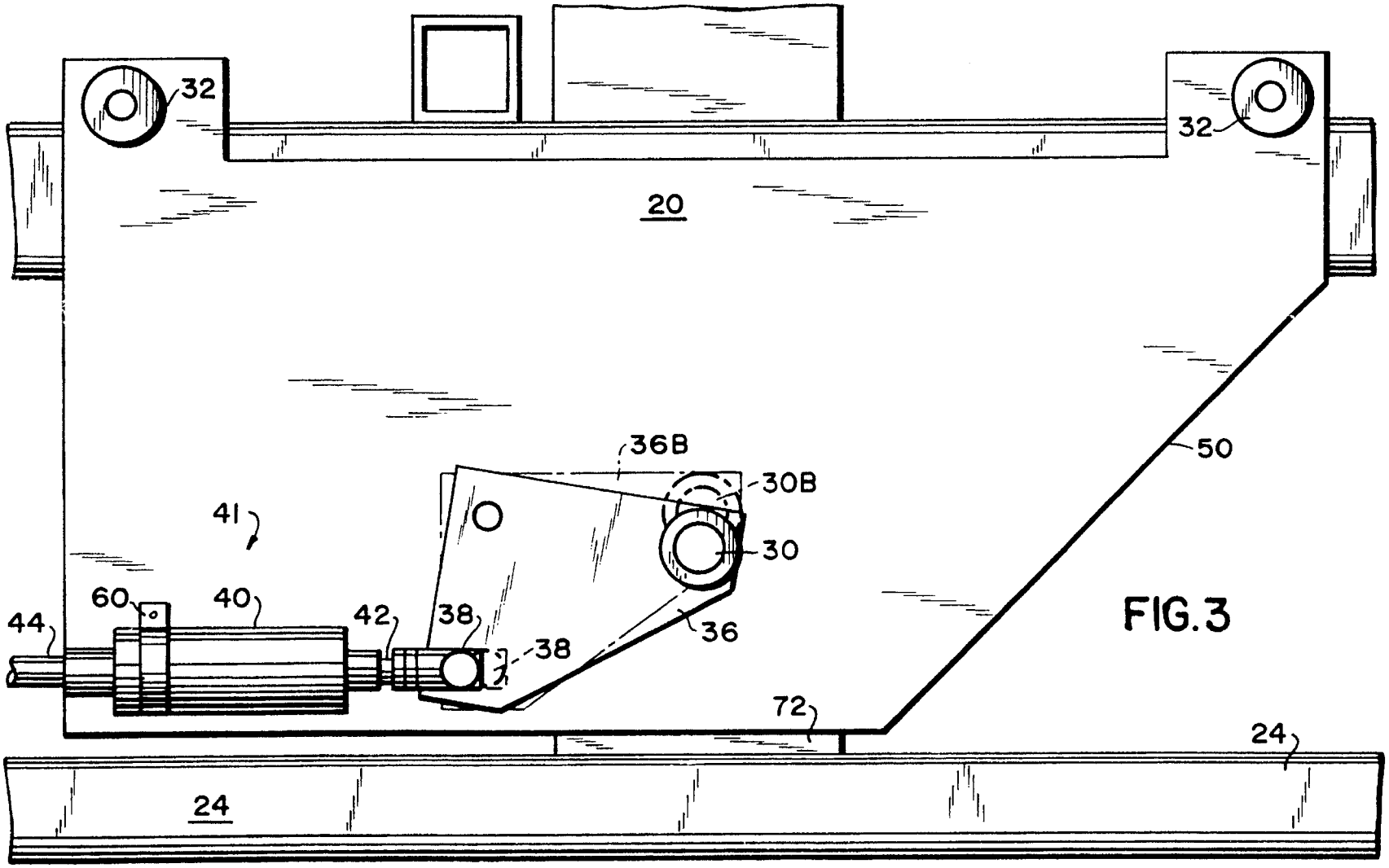
FIG. 3 is a top plan view of one version of the locator assembly of the invention shown before activation, with dotted lines showing the locator arm and attached roller after activation.

In FIGS. 2 and 3 the pallet support plate locator-stabilizer mechanism 41 is clearly depicted. A locator plate 50 is affixed beneath first rail 22 and second rail 24, being connected to second rail 24 via a steel bar 72. A cylinder 40 is affixed to the upper surface of the locator plate 50. In this version of the invention the cylinder is air driven , air being supplied via air line 44 which is connected to a source of compressed air (not shown). Cylinder rod 42 connects the cylinder to a clevis link 38. The clevis link being secured to a locator arm 36. The locator arm can be generally triangular in shape, with a roller 30 being rotatably affixed to the locator arm. As best seen in FIG. 3, when activated by a micro switch 60 affixed to the cylinder 40 air pressure causes cylinder rod 42 to extend, thereby moving roller 30 from its original non-operating position to an operating position 30B indicated by the dotted lines, as is the altered position of the locator arm 36 to it operating position 36B as indicated by the dotted lines. Rotatably affixed to the front edge of the locator plate 50 are two cam followers 32. The roller 30 and the cam followers 32 can be made out of a variety of materials, in this case steel being the preferred material for long term wearing qualities. It should be noted that while the cam followers 32 are usually fixed in a specific position at most printing stations, at those stations adjacent to beginning of an oval track for the chain drive, provisions are made (not shown) for one of the cam followers to be moved out of the way of the pallet support plate as the plate is indexed around the oval end of the screen printing machine.

In FIG. 2 a pallet support plate 12 is shown having been indexed in place under a print head (not shown). The rear section 20 of the support plate is secured to two pins emanating from beneath the chain drive 29, with its rear edge 21B stabilizer bars 48 located beneath the under surface of the first rail 22 structure of the screen printing machine. The polyethylene pad 52 on the under surface of the front section 18 of the pallet support plate is shown in contact with the second rail 24 of the frame of the machine. The locator plate 50 with its associated cylinder 40, locator arm 36 and roller 30 are positioned beneath the pallet support plate with the locator arm located in the same horizontal plane as the rear section 20 of the plate, together with the cam followers 48 which are rotatably affixed to the upper surface of the locator plate.

The locator-stabilizer assembly of the invention cooperates with the pallet support plate in the following manner. (1) The plate 12 is connected to the drive mechanism (contained in a metal housing 26 beneath the first rail 22 of the machine) of the screen printing machine by inserting the rear section 20 of the plate under the first rail 22 of the machine, allowing chain drive pins 27 to be secured in openings 27A in grommets 55 and 56. The front section 18 of the plate is secured on the upper surface of the second rail 24 of the machine. (2) The pallet support plate is indexed by the chain drive on a timed sequence to a position beneath each of the print heads (not shown). (3) A valve (not shown) on the cylinder now allows air into the cylinder, causing the cylinder rod to move the clevis link 38 and connected locator arm from a non-operating position to an operating position. (4) The roller 30 then presses into the "V" shaped notch in the front end 21B of the pallet support plate rear section, thereby not only accurately locating and positioning the pallet support plate, but also biasing the plate in a rearward direction so that the stabilizer bars 48 on the rear edge 21A of the rear section 20 firmly contact the cam followers 32 on the locator plate 50, thereby locking the entire pallet support plate 12 into a precise position both front to back and laterally relative to the position of the print head and its associated printing screen. (5) A timed sequence then causes the valve (not shown) to release the air pressure from the cylinder, thereby causing the locator arm 36 and its connected roller 30 to move back into its non-operating position, freeing the pallet support plate to be able to be indexed on to the next printing station.

FIGS. 1 and 1A indicate the unique advantage of this rear section located and stabilized pallet support system. As is clearly seen in FIGS. 1, 1A, and 2, the front section 18 of the plate is completely free and conveniently available for an operator to connect virtually any object to be screen printed upon. For example, in FIG. 1 a bag 16, having a handle 70, an open end 66, and a closed end 68 is shown being processed on a version of the screen printing machine of the invention. Objects such as the illustrated bag 16 and long garments (not shown) simply cannot be processed on prior art machines due to the front locator mechanism. In addition to making the machine more versatile, the rear section single locator and stabilizer bar combination provide for increased economical fabrication, and significantly reduced maintenance requirements during operation.

An alternative structure should be mentioned to the above described stabilizer bars affixed to the rear edge of the rear section of the pallet support plate. The entire pallet support plate, or at least the rear section of the support plate, can be fabricated in steel. In this case the affixed stabilizer bars can be eliminated since the steel structure of at least this rear section of the plate would provide the required long term wearing characteristics.

Since many changes could be made in the above constructions and many apparent widely different embodiments of this invention could be made without departing from the scope thereof, it is intended that all matter contained in above description or shown in the accompanying drawings shall be interpreted as illustrative, and the scope is to be limited only by the following claims.

What is claimed is:

1. A pallet support plate assembly for use in a multicolor screen printing machine, a pallet support plate of said assembly being moved into and out of registry with a print head of said printing machine in a timed sequence, said pallet support plate assembly comprising:

(a) said pallet support plate;

(b) means for coupling and decoupling a pallet to said pallet support plate, said pallet having means for securing an object to be screen printed by said print head during said print cycle;

(c) said pallet support plate having a rear section and a front section, said rear section having a rear edge;

(d) locating means for locating and engaging directly upon said rear section prior to said print cycle;

(e) said rear section of said pallet support plate having means for accepting said means for locating and engaging said rear section; and (f) means for stabilizing said rear section of said pallet support plate including said locating means biasing said pallet support plate in a direction towards said rear edge of said rear section so that said rear edge of said rear section makes contact with a further portion of said stabilizing means, said locating means cooperating with said stabilizing means so that said pallet support plate is accurately positioned in a pre-determined spacial relationship to said print head prior to said print cycle, said locating means having means for disengaging said rear section after said print cycle so that said pallet support plate can be moved to a second print head, and so on in said timed sequence.

2. The pallet support plate assembly according to claim 1 wherein said rear section having means for accepting said locating means comprises an opening in said rear section, said rear section having a left side and a right side, said opening being located substantially midway between said left side and said right side along a line substantially parallel to the rear edge of said rear section.

3. The pallet support plate assembly according to claim 2 wherein said locating means for engaging said rear section is a locator arm with attached roller, said locator arm positioning said roller into said opening in said rear section prior to said print cycle during said timed sequence, said locator arm with attached roller simultaneously biasing said pallet support plate in a direction towards said rear edge of said rear section so that said rear edge of said rear section makes contact with said further portion of said stabilizing means.

4. The pallet support plate assembly according to claim 3 wherein said locator arm with attached roller is activated by a fluid driven cylinder causing said roller to engage said opening prior to said print cycle, and to disengage said opening after said print cycle during said timed sequence.

5. The pallet support plate assembly according to claim 3, said rear edge having a left hand corner and a right hand corner, said pallet support plate assembly further comprising two stabilizer bars, one bar being affixed to the rear edge of the rear section adjacent the left hand corner of said rear edge, a second bar being affixed to the rear edge of the rear section adjacent the right hand corner of said rear edge, said further portion of said stabilizing means including two cam followers, each of said bars contacting one of said two cam followers rotatably mounted on a locator plate affixed to a frame of said screen printing machine, said locator plate being in registry with said print head, so that when said locator arm and attached roller engages and biases said rear section, said stabilizer bars are caused to contact said cam followers, said pallet support plate thereby being locked into a pre-determined position relative to said print head both in the front to back position of said pallet support plate, and laterally of said pallet support plate.

6. The pallet support plate assembly according to claim 1 wherein said pallet support plate has a step section separating said rear section and said front section, said step section being connected in between and perpendicular to said rear section and said front section, said rear section and said front section being parallel to each other, said rear section and said front section being separated from each other a spaced distance by said step section, said rear section also having a left side and a right side, and a front edge.

7. The pallet support plate assembly according to claim 6 wherein said means for accepting said locating means comprises a "V" shaped notch located substantially midway along the width of said front edge of said rear section.

8. The pallet support plate assembly according to claim 7 wherein said locating means for engaging said rear section is a locator arm with attached roller, said roller being positioned into said "V" shaped notch in said front edge of said rear section when said locator arm is activated during said timed sequence, said roller simultaneously biasing said pallet support plate in a direction towards said rear edge of said rear section so that said further portion of said stabilizing means are engaged.

9. The pallet support plate assembly according to claim 8 wherein said locator arm with attached roller is activated by a fluid driven cylinder which causes said roller to locate and engage said "V" shaped notch after said print cycle, during said timed sequence.

10. The pallet support plate assembly according to claim 8, said rear edge having a left hand corner and a right hand corner, said pallet support plate assembly further comprising two stabilizer bars, one bar being affixed to said rear edge of said rear section adjacent the left hand corner of said rear edge, a second bar being affixed to said rear edge of said rear section adjacent the right hand corner of said rear edge, said further portion of said stabilizing means including two cam followers, each of said bars contacting one of said two cam followers rotatably mounted on a locator plate affixed to the frame of said screen printing machine, said locator plate being in registry with said print head, so that when said roller engages and biases said rear section said stabilizer bars are caused to contact said cam followers, said pallet support plate thereby being locked into a pre-determined position, relative to said print head, in both a front to back position of said pallet support plate, and laterally of said pallet support plate.

11. A method for locating and stabilizing a pallet support plate and its associated pallet and object to be printed upon in a screen printing machine so that different color impressions can be made on said object in a pre-determined registry while at the same time maintaining the normal loading and unloading end of the pallet support plate completely accessible for connecting closed end objects such as bags, said pallet support plate having a rear section and a front section, said rear section having a rear edge comprising the steps of:

(a) loading said front section of said pallet support plate with an object to be printed upon;

(b) indexing said pallet support plate into registry with a print head;

(c) locating said rear section of said pallet support plate by engaging directly upon said rear section of said pallet support plate;

(d) stabilizing said pallet support plate by biasing said rear section, when locating and engaging said rear section into coacting relationship at said rear edge of said rear section with means for stabilizing said pallet support plate;

(e) printing a color on said object to be printed upon;

(f) disengaging said rear section of said pallet support plate; and (g) continuing said indexing of said pallet support plate until a pre-determined number of correctly registered color impressions have been screen printed on said object.

12. The method according to claim 11 wherein said step of locating and engaging said rear section of said pallet support plate is accomplished by inserting a roller into a "V" shaped notch in a front edge of said rear section.

13. The method according to claim 12 wherein said step of stabilizing said pallet support plate is accomplished by said roller inducing stabilizer bars affixed to said rear edge of said rear section to contact said means for stabilizing, said means for stabilizing comprising a pair of cam followers positioned on a frame of said screen printing machine so that contact occurs between said stabilizer bars and said cam followers at a left hand corner of said rear edge of said rear section and a right hand corner of said rear edge of said rear section.

* * * * *